US006232864B1

(12) United States Patent
Hosozawa et al.

(10) Patent No.: US 6,232,864 B1
(45) **Date of Patent: *May 15, 2001**

(54) GAP-PROVIDING FERRITE CORE HALF AND METHOD FOR PRODUCING SAME

(75) Inventors: Takashi Hosozawa; Kazuhiro Umezane, both of Tottori (JP)

(73) Assignee: Hitachi Metals, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/962,653

(22) Filed: Nov. 3, 1997

Related U.S. Application Data

(63) Continuation of application No. 08/574,019, filed on Dec. 18, 1995, now abandoned.

(30) Foreign Application Priority Data

Dec. 16, 1994 (JP) ..... 6-334138
Dec. 16, 1994 (JP) ..... 6-334139

(51) Int. Cl.[7] ..... H01F 17/06
(52) U.S. Cl. ..... 336/178; 336/165
(58) Field of Search ..... 336/178, 165, 336/135

(56) References Cited

U.S. PATENT DOCUMENTS

| | | | | |
|---|---|---|---|---|
| 2,401,175 | * | 5/1946 | Morrill | 336/135 |
| 3,518,595 | * | 6/1970 | Dawson et al. | 336/135 |
| 4,837,923 | | 6/1989 | Brar et al. | 29/603.16 |
| 4,998,174 | | 3/1991 | Wada et al. | 360/103 |
| 5,007,158 | | 4/1991 | Ino et al. | 29/603 |
| 5,033,184 | | 7/1991 | Tandai | 29/603.06 |
| 5,099,376 | | 3/1992 | Ino et al. | 360/120 |
| 5,195,004 | | 3/1993 | Okuda et al. | 360/126 |

FOREIGN PATENT DOCUMENTS

| | | | | |
|---|---|---|---|---|
| 800131 | * | 8/1958 | (GB) | 336/178 |
| 62-130501 | | 6/1987 | (JP) . | |
| 4-329609 | | 11/1992 | (JP) . | |
| 6-96941 | | 4/1994 | (JP) . | |
| 6-70219 | | 9/1994 | (JP) . | |
| 6-297306 | | 10/1994 | (JP) . | |

* cited by examiner

*Primary Examiner*—Anh Mai

(57) ABSTRACT

The gap-providing ferrite core half is produced by grinding an abutting surface of a ferrite core half by a rotating grinder with a rotation shaft inclined by 0.1–45° relative to a line vertical to a surface of the ferrite core half to be ground in a plane parallel to a core width direction, so that the resultant gap-providing recess is constituted by a concave elliptical plane expressed by the following formula:

$$\frac{A^2}{4R^2} + \frac{(R\sin\theta - G)^2}{R^2\sin^2\theta} = 1,$$

wherein A is a width of the ferrite core half, R is an effective radius of the grinder, θ is an inclination angle of the rotation shaft of the grinder relative to a line vertical to a surface of the ferrite core half to be ground, and G is a gap depth.

8 Claims, 12 Drawing Sheets

15

GAP-PROVIDING FERRITE CORE HALF AND METHOD FOR PRODUCING SAME

This application is a continuation, of application Ser. No. 08/574,019, filed Dec. 18, 1995, now abandoned.

BACKGROUND OF THE INVENTION

The present invention relates to a gap-providing ferrite core half and a method for producing it.

One example of conventional gap-providing ferrite core halves is shown in FIG. 21. An E-type ferrite core half 63 comprising two outside leg portions 61 and one center leg portion 62 which is shorter than each outside leg portion 61 by a distance called a gap "G." The gap is provided for the purpose of controlling direct-current superposition properties of the ferrite core.

A conventional ferrite core 220 with a gap for transformers, choke coils, etc. as shown in FIG. 22 is formed by combining a gap-providing E-type ferrite core half 63 as shown in FIG. 21 and an E-type ferrite core half 64 with no gap-providing recess such that legs of both core halves abut each other, with a coil disposed around the aligned center leg portions. Such a combination of core halves is called "EE-type core assembly" or simply "EE-type core."

In addition to an EE-type ferrite core, there is an EI-type ferrite core comprising a gap-providing E-type ferrite core half as shown in FIG. 21 and a flat I-type ferrite core half. Though the gap-providing E-type ferrite core half shown in FIG. 21 has three legs, there may be ferrite core halves having two or four or more legs.

The provision of a gap-providing recess to a ferrite core half has been achieved by forming a ferrite core half 230 having outside leg portions 65*a*, 65*a* and a center leg portion 65*b* of the same length (shown in FIG. 23), sintering it, grinding flat an end surface 66 of each leg 65, and further grinding an end surface 66 of a center leg portion 65*b* only. Also, as shown in FIG. 24, with an integral diamond grinder 67 rotatable around an axis 69 and having a grinding layer 68 disposed on a stepwise surface of the grinder 67 such that the grinding layer 68 is complementary with the legs of a ferrite core half to be ground, abutting surfaces of the legs of the E-type ferrite core half can be ground.

FIG. 25 is a perspective view showing another example of the conventional gap-providing ferrite core half, and FIG. 26 is a front view showing the gap-providing ferrite core half of FIG. 25. This gap-providing ferrite core half is a U-type ferrite core half 101 with two legs 102, 103, one leg 103 being shorter than another leg 102 by a distance called a gap "G" for the purpose of controlling direct-current superposition properties of the ferrite core. This gap-providing ferrite core half 101 is combined with a U-type ferrite core half 104 of the same shape without a gap-providing portion to form a transformer with a coil wound around one leg.

In this conventional gap-providing U-type ferrite core half, only one leg thereof is provided with a gap-providing recess as shown in the drawings. In this case, end surfaces of two legs are ground flat to a high precision, and an end surface of only one leg is further ground to a predetermined depth to provide a gap-providing recess.

Since a gap dimension greatly affects the properties of these ferrite core assemblies with gaps, it is important to provide the gap dimension with a high precision. However, since a particular leg end is ground after all leg ends are ground flat in the conventional gap-providing method, two grinding steps are needed, making the production cost high.

Further, since the grinding of the center leg portion is conducted at a different work position from the previous one at which the outside leg portions are ground, it is difficult to provide a gap-providing recess with a high grinding precision.

Though it is possible to grind both outside leg portions and a center leg portion simultaneously with an integral grinder as shown in FIG. 24, grinders having different grinding surfaces should be prepared for ferrite core halves with different gap-providing recesses, making the types of the grinders stocked extremely many. For this reason, the conventional methods suffer from high production cost due to large numbers of grinding steps and difficulty in fine control of gap dimension.

If a sufficient number of steps are used with an expensive grinding machine, a gap dimension with a high precision may be obtained. However, this would be low in productivity and high in cost.

As shown in FIG. 27, a ferrite core assembly with a gap may be constituted by two ferrite core halves 105, 105 each having no gap-providing recess, with one or two spacers 106, 106 inserted between the ends of aligned legs.

In case where a spacer is inserted between the abutting ends of legs to provide a gap-providing recess, there are the following disadvantages:

(1) The step of inserting a spacer is necessary;

(2) Varieties of spacers should be prepared depending on the gap dimensions;

(3) Particularly in the case of a small gap dimension, an extremely thin spacer is needed, making its handling difficult.

As mentioned above, there have not been gap-providing ferrite core halves which can be produced precisely at a high productivity and low cost.

SUMMARY OF THE INVENTION

An object of the present invention is to provide a ferrite core half with a high-precision gap-providing recess which can be produced at a high productivity and low cost.

Another object of the present invention is to provide a method for producing such a gap-providing ferrite core half at a high productivity and low cost.

As a result of research in view of the above objects, the inventors have found that by grinding an abutting end surface of a leg of a ferrite core half along a concavely curved plane, a high-precision gap dimension can be achieved, and that such a concavely curved surface of the abutting end of a leg can be formed by grinding with a rotating grinder whose rotation shaft is slightly inclined in a plane vertical to a core surface to be ground and parallel to a core width direction.

Thus, the gap-providing ferrite core half according to the present invention comprises at least one abutting end surface whose envelope extends along a concavely curved plane, and a distance between the highest point and the lowest point in the abutting end surface being 1 $\mu$m or more.

The ferrite core assembly with a gap according to the present invention is constituted by two ferrite core halves with their end surfaces abutting each other, at least one ferrite core half having an abutting surface whose envelope extends along a concavely curved plane, and the gap being 1 $\mu$m or more at a deepest point.

The method for producing a gap-providing ferrite core half according to the present invention comprises the step of grinding an abutting surface of a ferrite core half by a rotating grinder with a rotation shaft inclined by 0.01–90° relative to a line vertical to a surface of the ferrite core half to be ground in a plane parallel to a core width direction, such that a distance between the highest point and the lowest point in the abutting surface is 1 μm or more. The gap-providing recess is preferably constituted by a concave elliptical plane expressed by the following formula:

$$\frac{A^2}{4R^2} + \frac{(R\sin\theta - G)^2}{R^2\sin^2\theta} = 1,$$

wherein A is a width of the ferrite core half, R is an effective radius of the grinder, θ is an inclination angle of the rotation shaft of the grinder relative to a line vertical to a surface of the ferrite core half to be ground in a plane parallel to a core width direction, and G is a gap depth.

BRIEF DESCRIPTION OF THE DRAWINGS

FIG. 3(*b*) is a front view showing an EE-type ferrite core assembly with a gap according to another embodiment of the present invention;

FIG. 7(*b*) is a front view showing a UU-type ferrite core assembly with a gap according to a still further embodiment of the present invention;

DETAILED DESCRIPTION OF THE PREFERRED EMBODIMENTS

Figure 1:
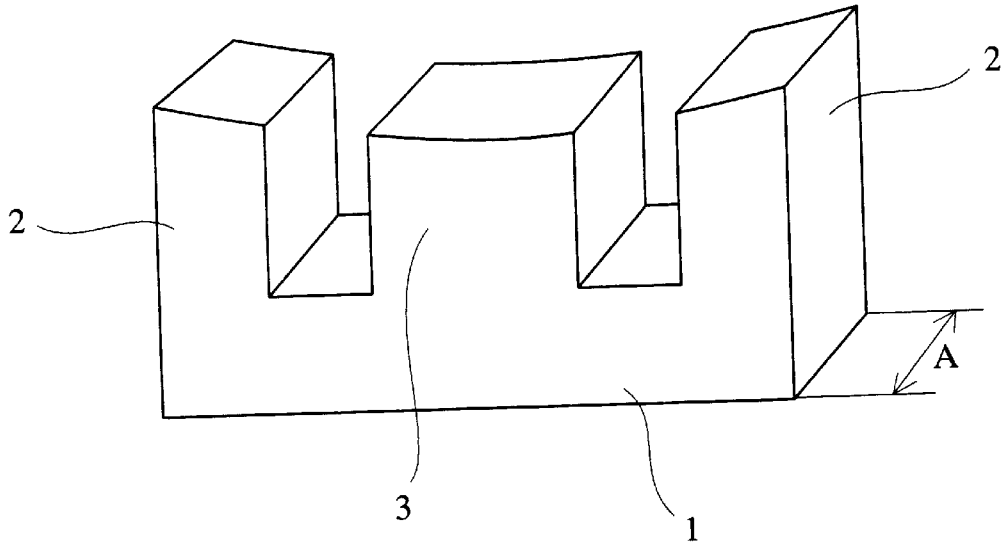
FIG. 1 is a perspective view showing an E-type ferrite core half with a gap-providing recess according to one embodiment of the present invention.

In the present invention, the gap-providing ferrite core half comprises at least one abutting end surface whose envelope extends along a concavely curved plane, and a distance between the highest point and the lowest point in the abutting end surface being 1 μm or more. The concavely curved plane may be circle or ellipse, and it is preferably an elliptical plane as mentioned below. The depth of the gap-providing recess "G," which is defined as a distance between the highest point and the lowest point in the abutting surface, is preferably 1 μm or more and 1 mm or less. With respect to the more preferable lower limit of the depth of the gap-providing recess "G," it is 5 μm or more. Also, with respect to the more preferable upper limit of the depth of the gap-providing recess "G," it is 0.1 mm or less.

The present invention will be explained in detail referring to the drawings attached hereto. It should be noted that a concavely curved plane of the gap-providing recess is exaggerated in each figure to make it easy to understand the relations of the gap-providing recess with the other parts of the ferrite core half.

Figure 2:
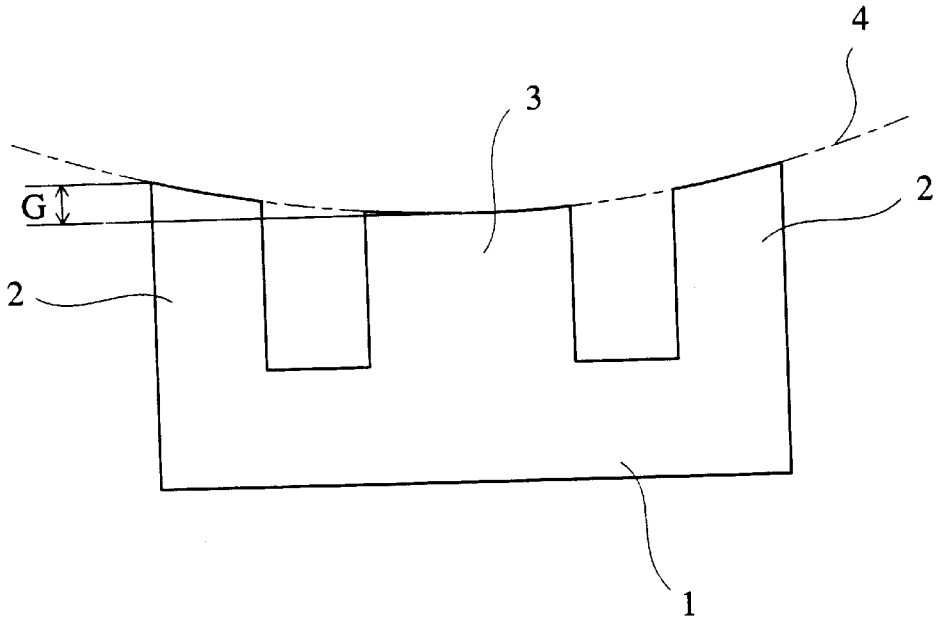
FIG. 2 is a front view of the E-type ferrite core half of FIG. 1.

FIG. 1 is a perspective view showing a gap-providing E-type ferrite core half according to the first embodiment of the present invention, and FIG. 2 is a front view of such a gap-providing E-type ferrite core half. In this embodiment, a gap-providing E-type ferrite core half 1 has two outside leg portions 2 and one center leg portion 3 whose end surfaces are formed in a concavely curved shape. The abutting end surfaces of all legs are in alignment with a hypothetical concavely curved plane 4. A distance between the highest point of the outside leg portions 2 and the lowest point of the center leg portion 3 is a gap-providing recess "G", which is preferably 1 μm or more.

Figure 3A:
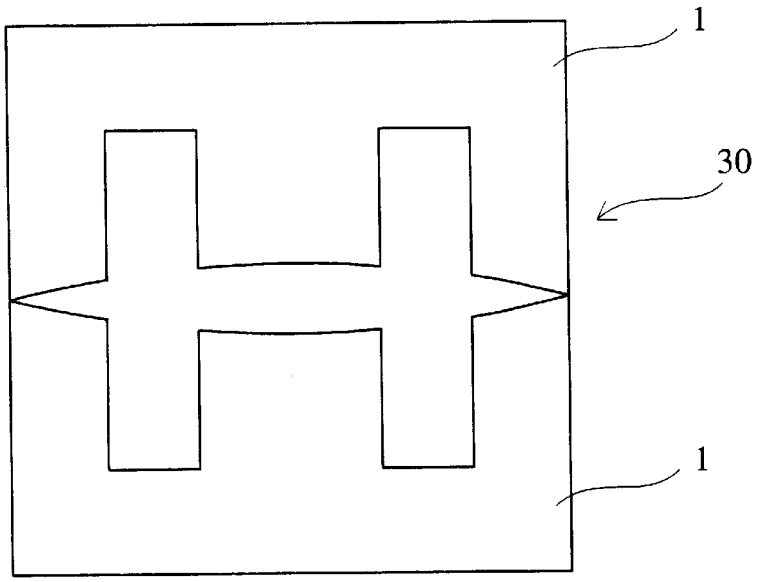
FIG. 3(*a*) is a front view showing an EE-type ferrite core assembly with a gap according to one embodiment of the present invention.
Figure 3B:
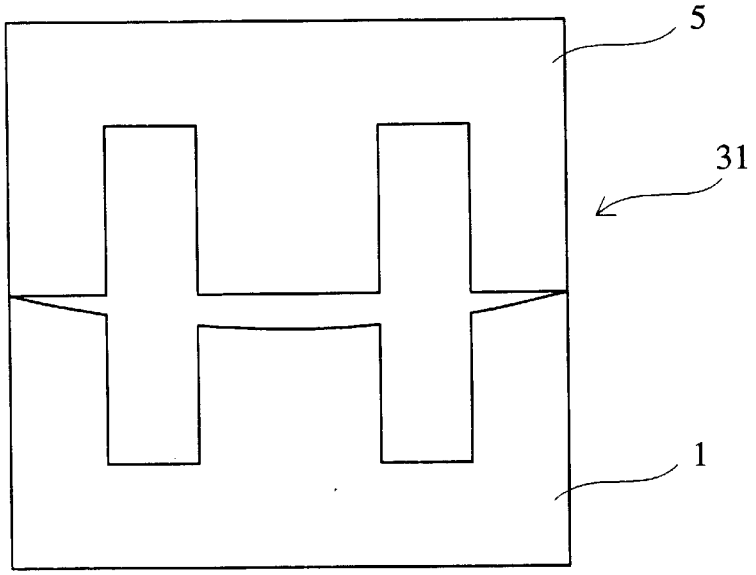
Figure 4:
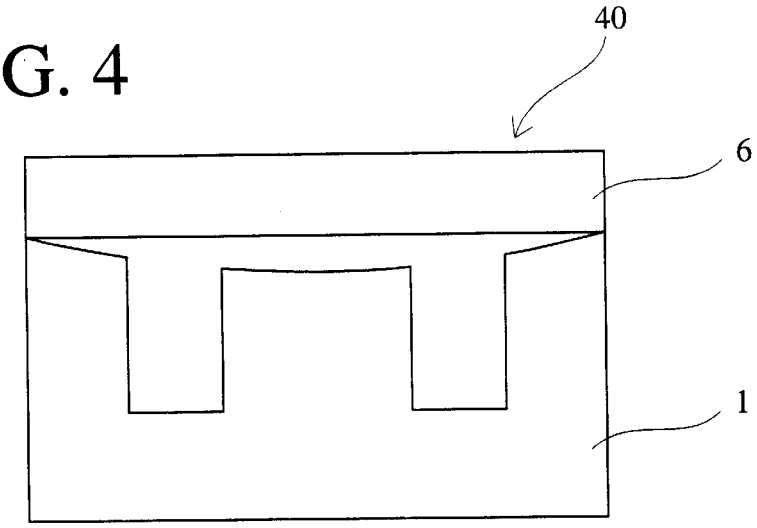
FIG. 4 is a front view showing an EI-type ferrite core assembly with a gap according to a further embodiment of the present invention.

As shown in FIG. 3(*a*), the EE-type ferrite core assembly 30 with a gap for transformers is formed by abutting two gap-providing E-type ferrite core halves 1, 1 with a wound coil disposed around the aligned center leg portions. Also, a gap-providing E-type ferrite core half 1 may be combined with an E-type ferrite core half 5 having a flat abutting surface to provide an EE-type ferrite core assembly 31 with a gap as shown in FIG. 3(*b*). In addition, the E-type ferrite core half 1 may be combined with an I-type ferrite core half 6 to provide an EI-type ferrite core assembly 40 with a gap as shown in FIG. 4.

Figure 5:
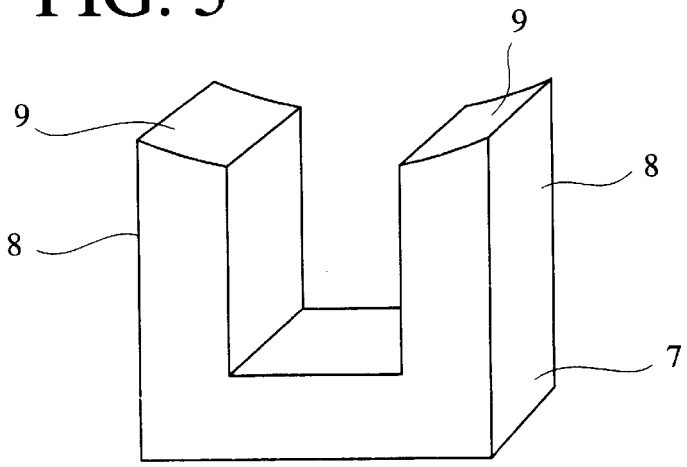
FIG. 5 is a perspective view showing a U-type ferrite core half with a gap-providing recess according to a still further embodiment of the present invention.
Figure 6:
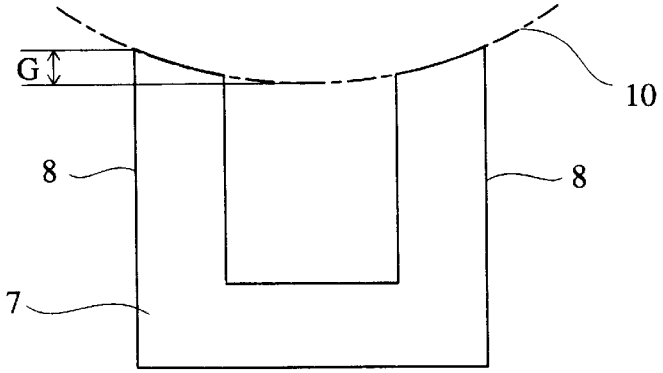
FIG. 6 is a front view showing the U-type ferrite core half of FIG. 5.

FIG. 5 is a perspective view showing a gap-providing U-type ferrite core half according to the second embodiment of the present invention, and FIG. 6 is a front view of such gap-providing E-type ferrite core half. In this embodiment, a U-type ferrite core half 7 has two legs 8 each having an abutting end surface 9 in a concavely curved shape. The abutting end surfaces 9, 9 of the two legs 8, 8 are in alignment with a hypothetical curved plane 10. A distance between the highest point and the lowest point of the legs 8, 8 is a gap-providing recess "G", which is preferably 1 μm or more.

Figure 7A:
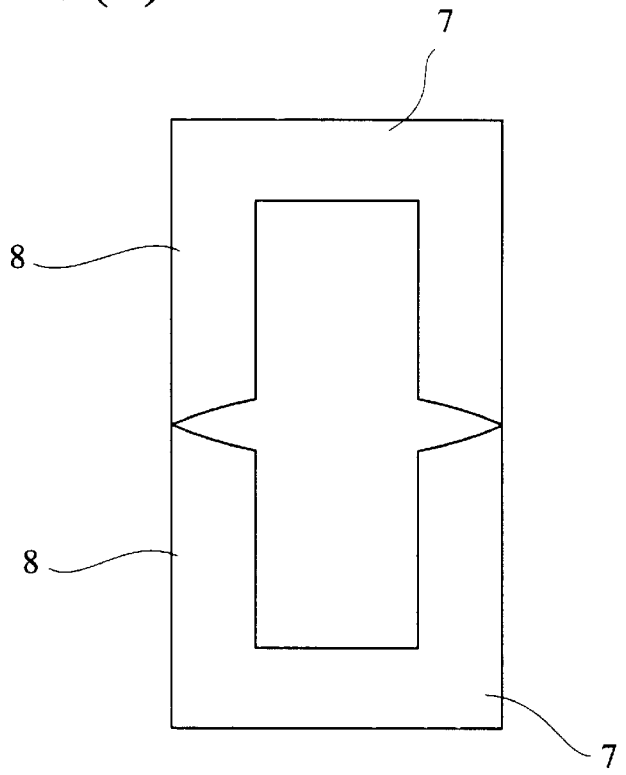
FIG. 7(*a*) is a front view showing a UU-type ferrite core assembly with a gap according to a still further embodiment of the present invention.
Figure 7B:
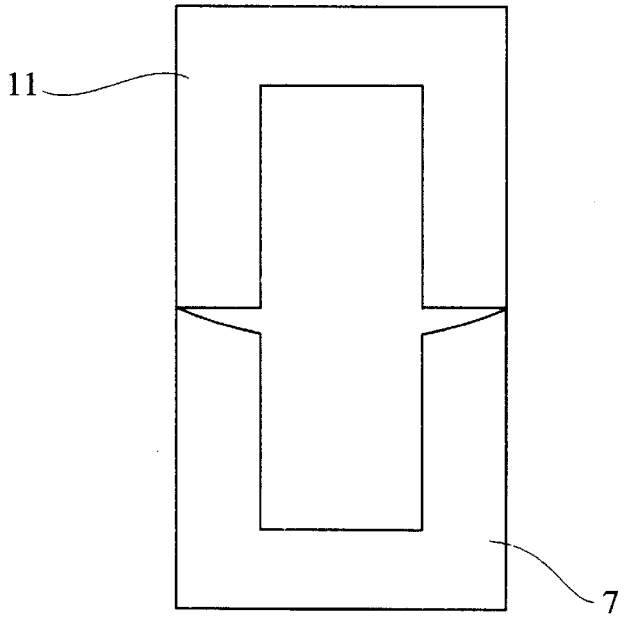

As shown in FIG. 7(*a*), a UU-type ferrite core assembly 70 with a gap for transformers is formed by abutting two U-type ferrite core halves 7, 7 with a wound coil disposed around one or both of the aligned legs 8, 8. Also, a gap-providing U-type ferrite core half 7 may be combined with a U-type ferrite core half 11 having a flat abutting surface as shown in FIG. 7(*b*).

Figure 8:
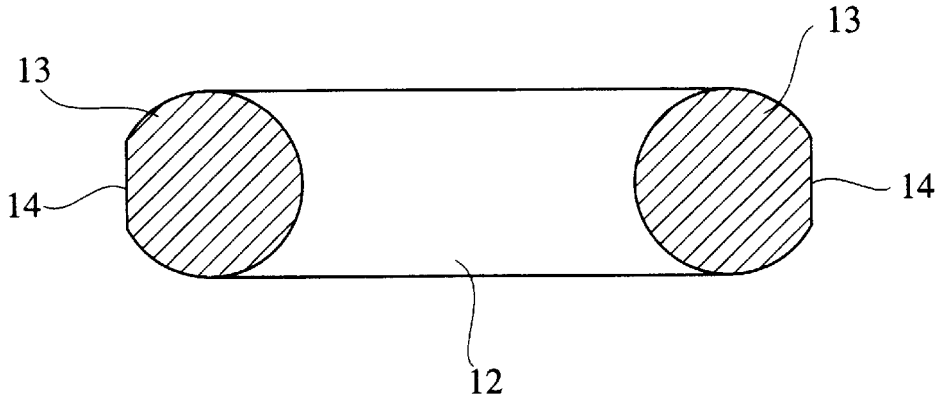
FIG. 8 is a partial cross-sectional view showing a U-type ferrite core half according to a still further embodiment of the present invention.

Though the leg 8 has a rectangular cross section as shown in FIG. 5, the leg 8 may have a cylindrical cross section. In the case of a leg with a cylindrical cross section, the end surface of a leg of one ferrite core half abuts the end surface of the leg of the other ferrite core half at a point, making the abutment of the two gap-providing ferrite core halves unstable. Accordingly, as shown in FIG. 8, each cylindrical leg portion 13 of the U-type ferrite core half 12 may be provided with a flat surface 14 on an outer side. With the flat surface 14, abutment can be achieved stably even if the abutting end surfaces of the legs 13, 13 are in a concavely curved shape. For this reason, the leg of the ferrite core half may have a cylindrical cross section in the present invention.

Figure 9:
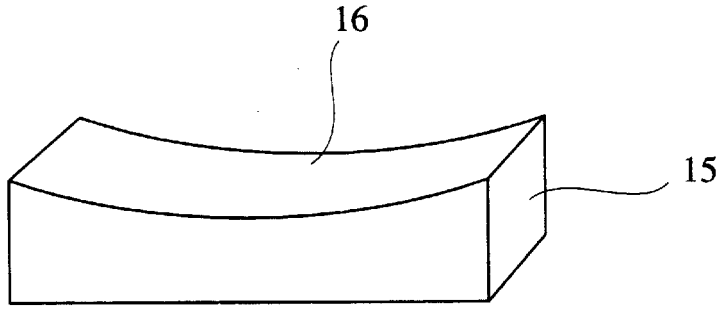
FIG. 9 is a perspective view showing an I-type ferrite core half with a gap-providing recess in one surface according to a still further embodiment of the present invention.
Figure 10:
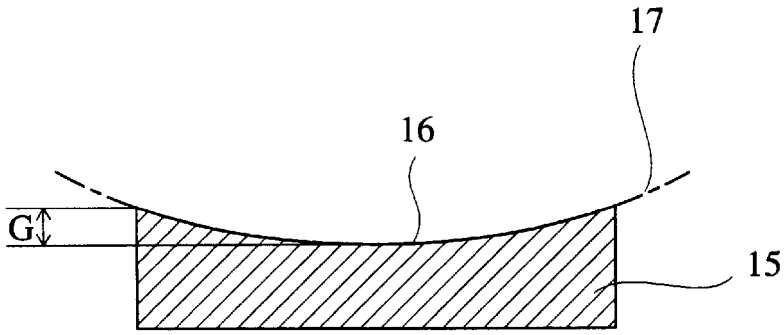
FIG. 10 is a cross-sectional view showing the I-type ferrite core half of FIG. 9.

FIG. 9 is a perspective view showing a gap-providing I-type ferrite core half according to the third embodiment of the present invention, and FIG. 10 is a cross-sectional view of such gap-providing I-type ferrite core half. In this embodiment, the I-type ferrite core half 15 has a concavely curved surface 16. The abutting end surface 16 of the I-type ferrite core half 15 is in alignment with a hypothetical curved plane 17. The depth of the gap-providing recess "G" is preferably 1 μm or more.

Figure 11:
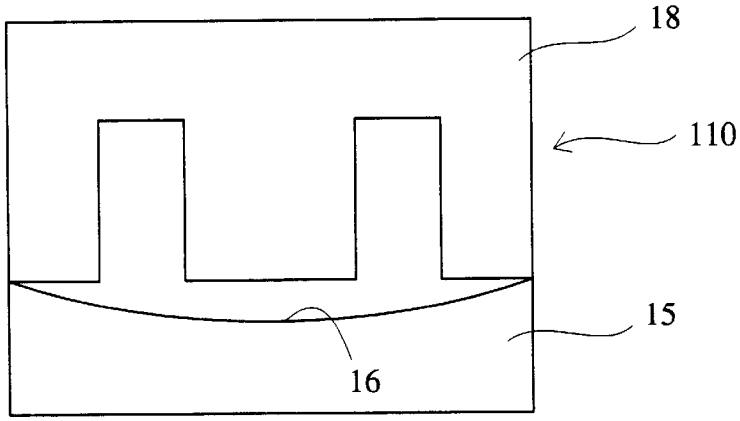
FIG. 11 is a front view showing an EI-type ferrite core assembly with a gap according to a still further embodiment of the present invention.
Figure 12:
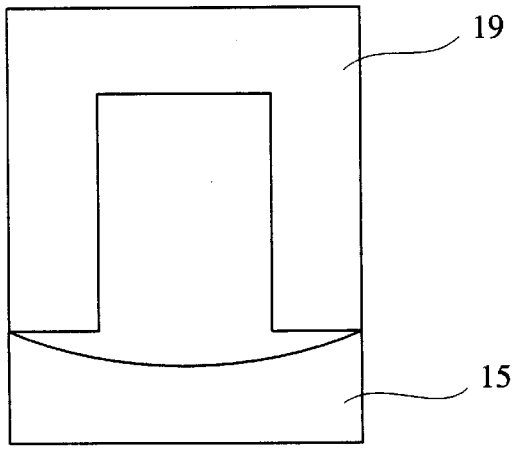
FIG. 12 is a front view showing a UI-type ferrite core assembly with a gap according to a still further embodiment of the present invention.
Figure 13:
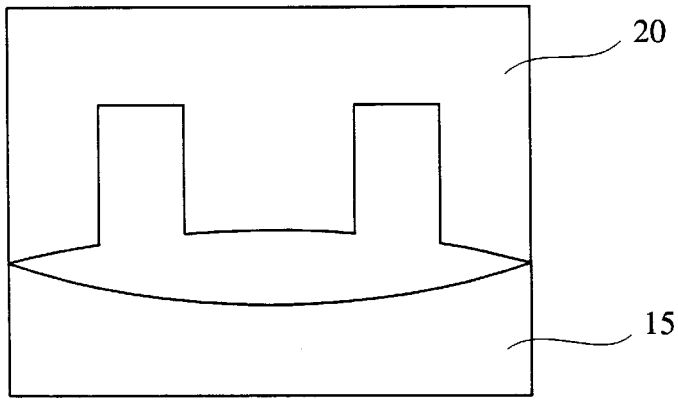
FIG. 13 is a front view showing an EI-type ferrite core assembly with a gap according to a still further embodiment of the present invention.

As shown in FIG. 11, the gap-providing I-type ferrite core half 15 may be combined with an E-type ferrite core half 18 with no gap-providing recess by abutting the concavely curved surface 16 of the I-type ferrite core half 15 to the end surfaces of the E-type ferrite core half 18, with a wound coil disposed around a center leg portion, thereby providing a transformer core 110. Also, the gap-providing I-type ferrite core half 15 may be abutted with a U-type ferrite core half 19 having flat abutting end surfaces as shown in FIG. 12. In addition, the abutting end surfaces of an E-type ferrite core half 20 having legs with concavely curved surface may be used as shown in FIG. 13.

In the present invention, the abutting end surfaces of the ferrite core half are provided with a gap-providing recess in a concavely curved shape. The gap-forming concavely curved surface is constituted by a hypothetical, continuous, concavely curved surface, preferably a continuous, concave, elliptical surface, which can be obtained by continuous grinding. Here, the term "continuous" means that the concavely curved surface of each abutting surface is in alignment with the same concavely curved plane.

Accordingly, a gap-providing ferrite core half with an extremely high precision can be obtained.

Figure 14:
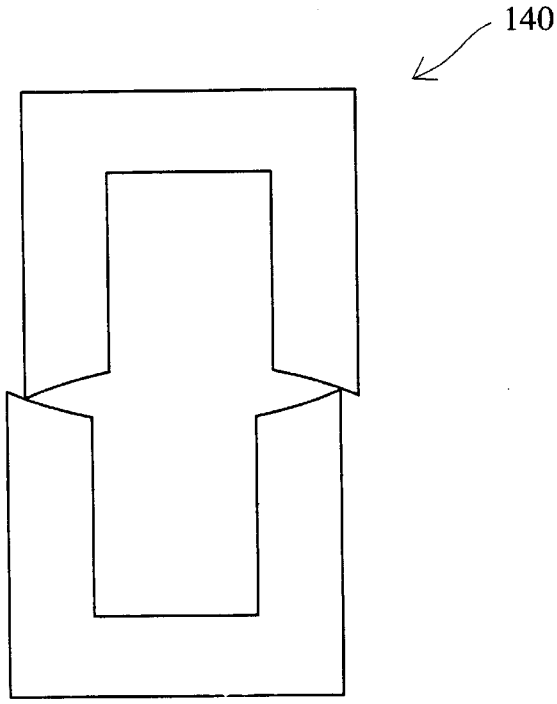
FIG. 14 is a front view showing a pair of U-type ferrite core halves which are combined together with a slight displacement according to a still further embodiment of the present invention.
Figure 15:
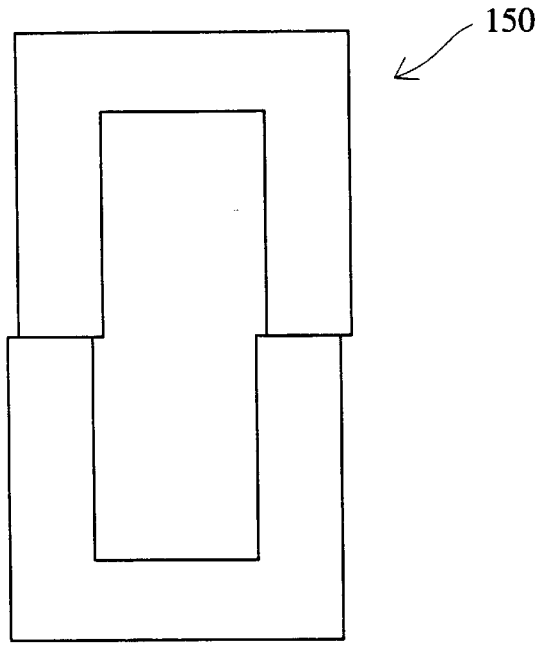
FIG. 15 PRIOR ART
FIG. 15 is a front view showing a pair of conventional U-type ferrite core halves which are combined together with a slight displacement.

Due to the concavely curved shape in the end surfaces of the ferrite core half, the deterioration of properties which may be caused by abutment can be prevented. FIG. 14 shows U-type ferrite core halves 140 of the present invention abutting each other, and FIG. 15 shows conventional U-type ferrite core halves 150 abutting each other. In both cases, displacement of end surfaces of legs is exaggerated for the purpose of explanation. In the conventional case of FIG. 15, contact areas of the legs are reduced by the displacement of end surfaces thereof, lowering the inductance of the ferrite core assembly thereby failing to achieve the desired properties. On the other hand, in the case of the U-type ferrite core halves of the present invention which are shown in FIG. 14, contact areas of the legs do not change even if there is displacement of end surfaces of the legs, making it possible to prevent the deterioration of the properties.

According to the present invention, the abutting end surface is ground with a grinder whose rotation shaft is inclined in a plane vertical to a core surface to be ground and parallel to a core width direction, so that the grinding layer of the grinder moves along an elliptical orbit. The elliptical orbit may be expressed by the following formula:

$$\frac{A^2}{4R^2} + \frac{(R\sin\theta - G)^2}{R^2\sin^2\theta} = 1,$$

wherein A is a width of the ferrite core half, R is an effective radius of a grinder, θ is an inclination angle of the rotation shaft of the grinder relative to a line vertical to a surface of the ferrite core half to be ground in a plane parallel to a core width direction, and G is a gap depth. See FIGS. 1 and 17.

The inclination angle θ of the rotation shaft of the grinder is 0.01–90°, preferably 0.1–45°, more preferably 0.5–20° relative to a line vertical to a surface of the ferrite core half to be ground in a plane parallel to a core width direction. The effective radius R of the grinder is preferably 1–300 mm, more preferably 20–200 mm.

By the method of the present invention, the overall surface of the abutting end of the ferrite core half can be ground by a single step. Namely, since the overall surface of the abutting end from the highest point to the lowest point is ground simultaneously, the gap-providing recess "G" is accurately provided.

According to the present invention, the orbit of grinding is determined by the diameter and shaft inclination of the grinder, and the gap depth is determined by the width of the ferrite core half. Accordingly, the required gap depth can be achieved by various means. For instance, by changing the inclination of the shaft of the grinder or by changing the diameter of the grinder, the gap depth can be changed. Of course, even with the same diameter and shaft inclination of the grinder, the gap depth changes as the width of the ferrite core half differs. Thus, the method of the present invention is extremely versatile, making it possible to form a high-precision gap-providing recess by a simple working step.

Figure 16:
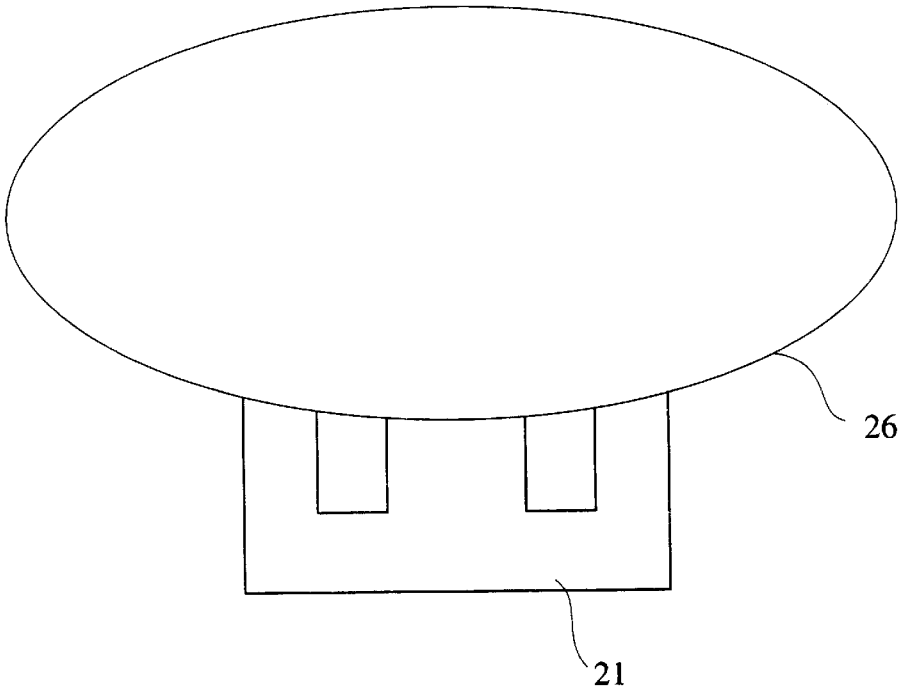
FIG. 16 is a schematic view showing a grinding method of an E-type ferrite core half with a gap-providing recess according to an embodiment of the present invention.
Figure 17:
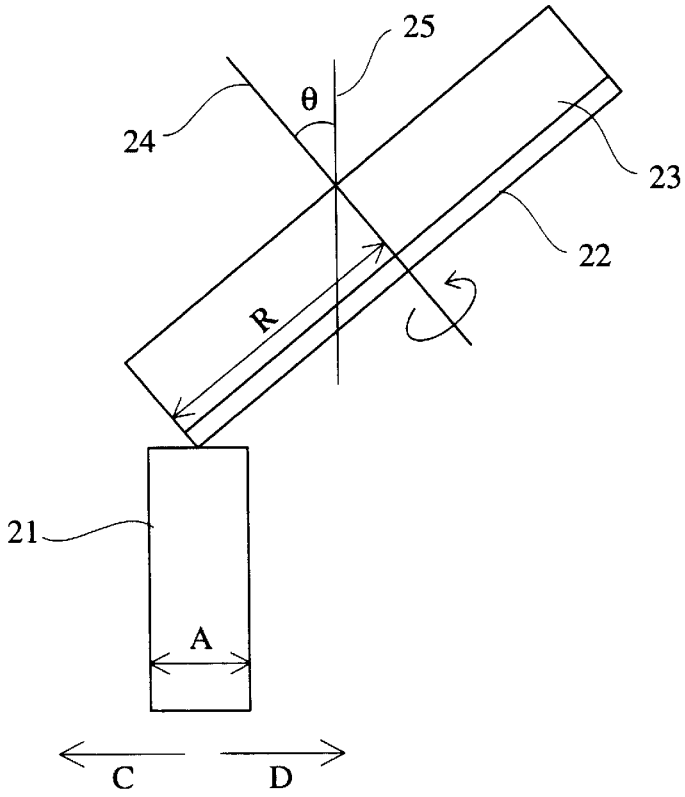
FIG. 17 is a side view showing the grinding method of FIG. 16.

FIG. 16 schematically shows a grinding method of a gap-providing E-type ferrite core half according to a further embodiment of the present invention, and FIG. 17 is a side view thereof. A rotation shaft 24 of a cup wheel 23 provided with a diamond grinder layer 22 is inclined by a degree of θ relative to a line 25 vertical to the end surface of the ferrite core half 21 to be ground in a plane parallel to a core width direction. Thus, the grinding orbit 26 is determined. With this cup wheel 23 rotating, the gap-providing E-type ferrite core half 21 is moved in the direction of C or D to grind an abutting end surface thereof. Thus, a gap-providing E-type ferrite core half as shown in FIG. 1 can be produced.

The present invention will be explained in further detail by way of the following Examples without intention of restricting the scope of the present invention thereto.

EXAMPLE 1

With a cup wheel having a diameter of 500 mm at an inclination angle θ of 0.97°, an E-type ferrite core half having a width of 15 mm and a height of 21 mm was ground to provide an E-type ferrite core half having a gap-providing recess G of 0.025 mm. In this example, 200 samples were produced in the same manner. As a result, the variation of the gap dimension was ±2 μm.

On the other hand, when only a center leg portion was ground according to the conventional method, the variation of the gap dimension was ±25 μm. Thus, it has been clarified that the grinding method of the present invention can produce a gap-providing E-type ferrite core half with one-tenth or less of variation in the gap dimension.

As shown in FIG. 3(*b*), the resultant gap-providing E-type ferrite core half was combined with an E-type ferrite core half with no gap to measure an AL value. The variation of the AL value was as good as ±3.5%. In the combination of a conventional E-type ferrite core half having a gap-providing recess G and an E-type ferrite core half with no gap-providing recess, the variation of the AL value was as large as +19.6% to −28%, much poorer than that of the present invention.

EXAMPLE 2

With a cup wheel having a diameter of 175 mm at an inclination angle θ of 4.3°, an E-type ferrite core half having a width of 2.0 mm and a height of 5.5 mm was ground to produce an E-type ferrite core half having a gap-providing recess G of 6 μm. In this example, the variation of the AL value was as good as ±6.0%.

EXAMPLE 3

With a cup wheel having a diameter of 200 mm at an inclination angle θ of 5.3°, an E-type ferrite core half having a width of 5.0 mm and a height of 7.0 mm was ground to produce an E-type ferrite core half having a gap-providing recess G of 10 μm. In this example, the variation of the AL value was as good as ±2.5%.

EXAMPLE 4

With a cup wheel having a diameter of 175 mm at an inclination angle θ of 4.3°, an E-type ferrite core half having a width of 3.0 mm and a height of 6.0 mm was ground to produce an E-type ferrite core half having a gap-providing recess G of 10 μm. In this example, the variation of the AL value was as good as ±4.0%.

EXAMPLE 5

Figure 19:
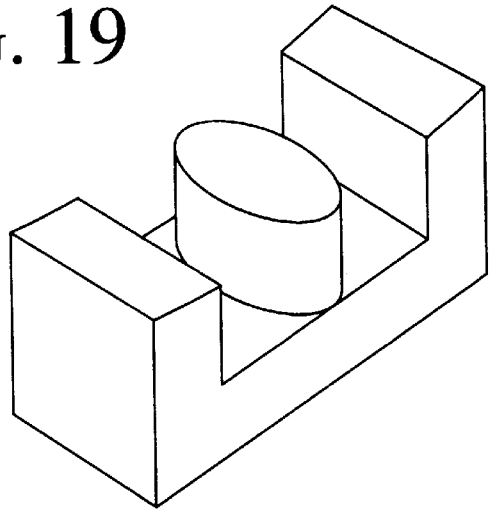
FIG. 19 is a perspective view showing a ferrite core half with a gap-providing recess according to a still further embodiment of the present invention.

The present invention was applied to an E-type ferrite core half having a cylindrical center leg portion as shown in FIG. 19. With a cup wheel having a diameter of 175 mm at an inclination angle θ of 9.3°, an E-type ferrite core half having a width of 12.0 mm and a height of 10.0 mm was ground to produce an E-type ferrite core half having a gap-providing recess G of 90 μm. In this example, the variation of the AL value was as good as ±1.0%.

On the other hand, when only a cylindrical center leg portion of the ferrite core half was ground according to the conventional method, the variation of the gap dimension was ±16 μm. Thus, it has been clarified that the grinding method of the present invention can produce a gap-providing E-type ferrite core half with one-fifteenth or less of variation in the gap dimension.

EXAMPLE 6

The present invention was applied to a U-type ferrite core half having an overall structure as shown in FIG. 5 and a leg section as shown in FIG. 8. With a cup wheel having a diameter of 175 mm at an inclination angle θ of 0.5°, a U-type ferrite core half having a width of 8.0 mm and a height of 25.0 mm was ground to produce an E-type ferrite core half having a gap-providing recess G of 6 μm. In this example, the variation of the AL value was as good as ±7.0%.

Figure 18:
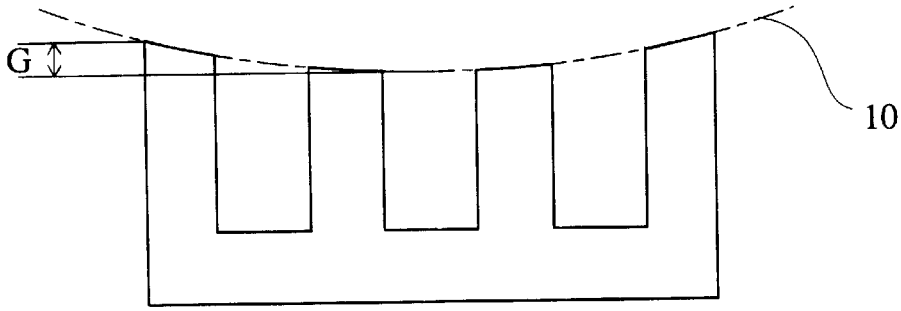
FIG. 18 is a front view showing a ferrite core half with a gap-providing recess according to a still further embodiment of the present invention.
Figure 20:
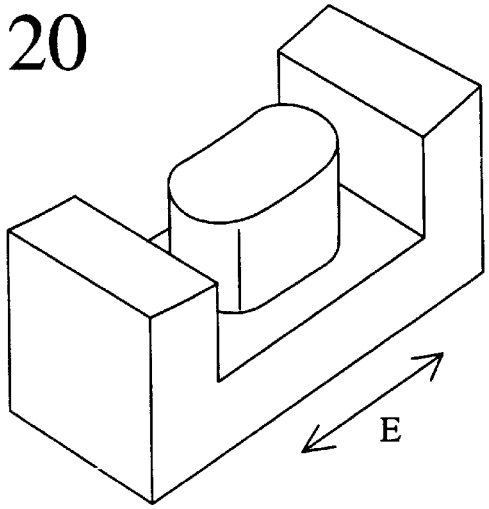
FIG. 20 is a perspective view showing a ferrite core half with a gap-providing recess according to a still further embodiment of the present invention.
Figure 21:
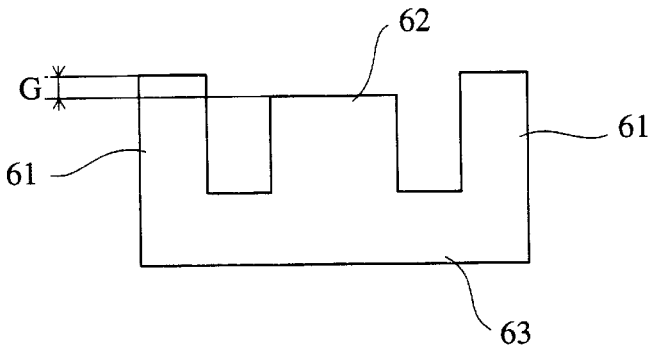
FIG. 21 PRIOR ART
FIG. 21 is a front view showing a conventional ferrite core half with a gap-providing recess.
Figure 22:
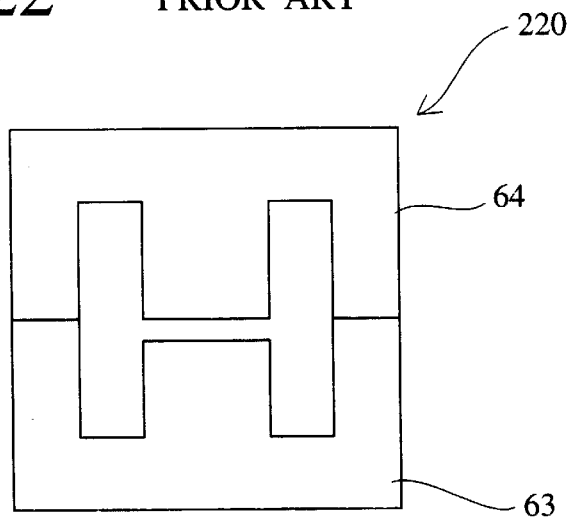
FIG. 22 PRIOR ART
FIG. 22 is a front view showing a conventional ferrite core assembly with a gap.
Figure 23:
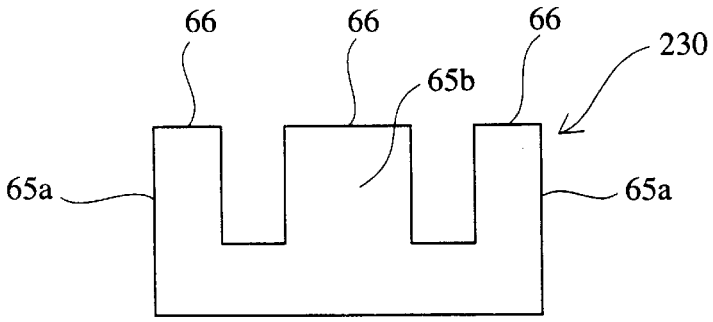
FIG. 23 PRIOR ART
FIG. 23 is a front view showing a conventional ferrite core half without a gap-providing recess.
Figure 24:
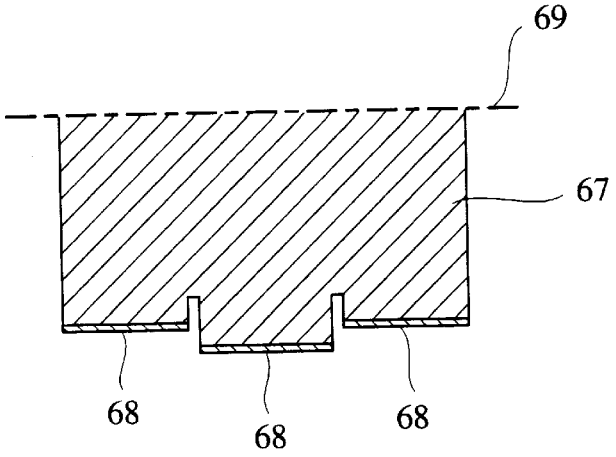
FIG. 24 PRIOR ART
FIG. 24 is a partial cross-sectional view showing a grinder used in the conventional method.
Figure 25:
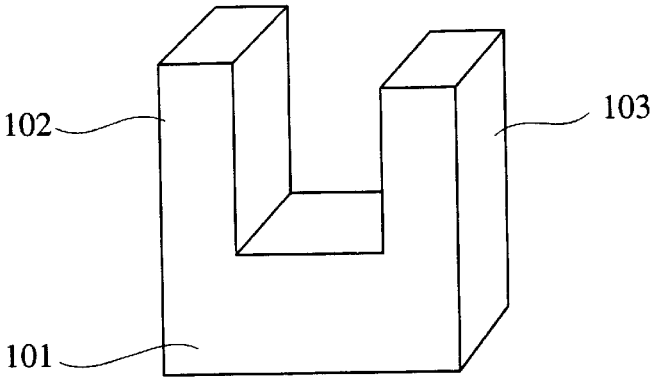
FIG. 25 PRIOR ART
FIG. 25 is a perspective view showing a conventional U-type ferrite core half with a gap-providing recess.
Figure 26:
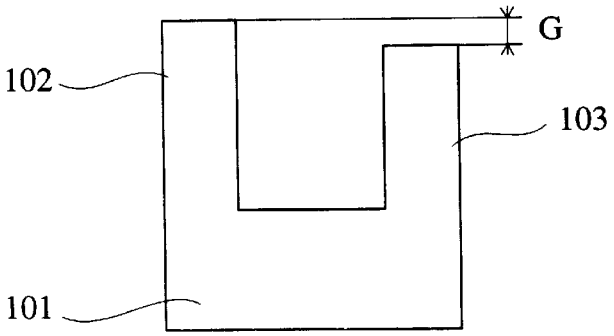
FIG. 26 PRIOR ART
FIG. 26 is a front view showing a conventional U-type ferrite core half with a gap-providing recess.
Figure 27:
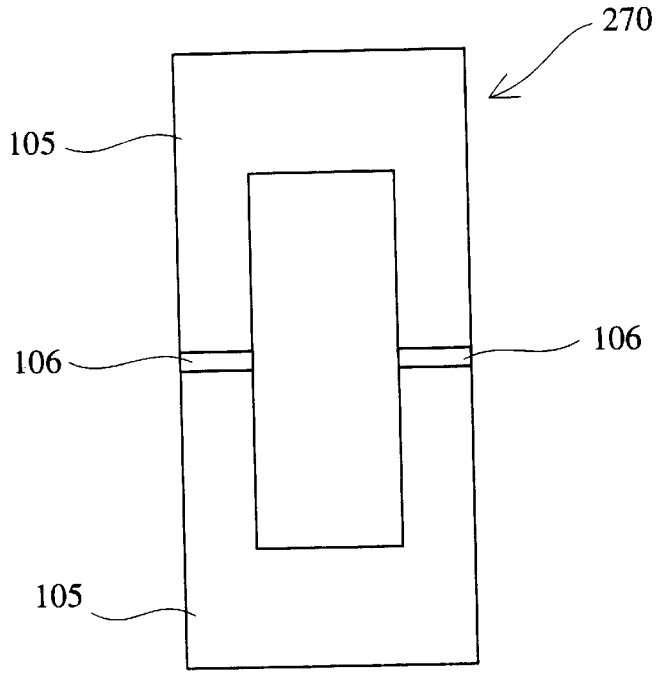
FIG. 27 PRIOR ART
FIG. 27 is a perspective view showing a conventional UU-type ferrite core assembly with spacers.
Figure 28:
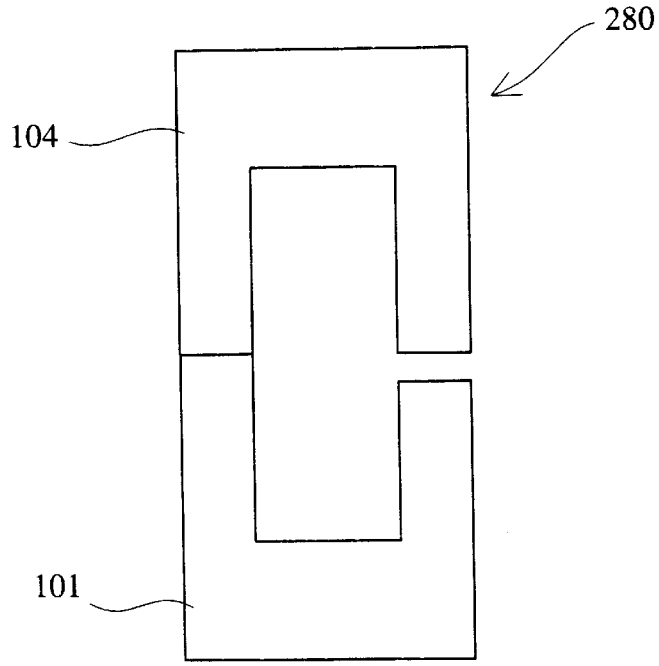
FIG. 28 PRIOR ART
FIG. 28 is a perspective view showing a conventional UU-type ferrite core assembly with a gap.

Though the present invention has been explained according to Examples above, it should be noted that the present invention is applicable to any shapes of ferrite core halves. For instance, a ferrite core half having three or more legs as shown in FIG. 18, a ferrite core half having a center leg portion extending longer in a direction E than in a transverse direction as shown in FIG. 20, a ferrite core half having a flat shape, a ferrite core half having a pot-like shape, etc. may also be used in the present invention.

Though there is a lowermost point of the curved surface at a center of the ferrite core half in the width direction in the above embodiments, the lowermost point of the curved surface may exist at a point deviated from a center of the ferrite core half. Also, the grinding surface (thus, rotation shaft) of a grinder may be inclined in a horizontal plane relative to a direction in which the grinder moves on the ferrite core half for grinding.

According to the present invention, even with a cup wheel having the same diameter, various gap dimensions can be obtained by changing the inclination angle θ of the rotation shaft and the core width. Further, by bringing a ferrite core half into contact with a grinder with its rotation shaft inclined in a plane vertical to a core surface to be ground and parallel to a core width direction, a ferrite core half having a gap-providing recess at a high-precision can be obtained. Also, since the grinding system of the present invention is relatively simple using a grinder whose rotation shaft is inclined in a plane vertical to a core surface to be ground and parallel to a core width direction, the overall grinding method of the present invention is less costly.

Further, when a rotating ferrite core half is moved toward a rotating grinder from below, too, the ferrite core half can be ground such that it is provided with a conical recess.

As mentioned above, a high-precision gap-providing recess can be provided to the ferrite core half according to the present invention without restrictions with respect to a shape of the ferrite core half. Also, a fine control of the gap dimension can easily be conducted while keeping a high-precision of the gap dimension.

What is claimed is:

1. A ferrite core assembly with a gap comprising two ferrite core halves with their end surfaces abutting each other with a gap therebetween, the end surface of at least one ferrite core half having an envelope extending along a concavely curved plane, and said gap being 1 μm or more at a widest point.

2. The ferrite core assembly with a gap according to claim 1, wherein at least one ferrite core half has at least two leg portions, and wherein each leg portion has an end surface whose envelope extending along a concavely curved plane.

3. The ferrite core assembly with a gap according to claim 1, wherein at least one ferrite core half is an I-shaped ferrite core half having an end surface whose envelope extending along a concavely curved plane.

4. The ferrite core assembly with a gap according to claim 1, wherein the end surface of at least one ferrite core half extends along a concave elliptical plane.

5. The ferrite core assembly with a gap according to claim 1, wherein said gap is from 1 μm to 1 mm at the widest point.

6. A ferrite core assembly with a gap, comprising two E-shaped ferrite core halves having their respective end surfaces abutting each other with a gap therebetween, each E-shaped ferrite core half having a center leg portion and two outside leg portions, the end surface of at least one of said E-type ferrite core halves having an envelope extending along a concavely curved plane, and said gap being 1 μm or more at a deepest point.

7. The ferrite core assembly with a gap according to claim 6, wherein the end surface of at least one ferrite core half extends along a concave elliptical plane.

8. The ferrite core assembly with a gap according to claim 6, wherein said gap is from 1 μm to 1 mm at the widest point.

* * * * *